US007219725B2

(12) United States Patent
Chisholm

(10) Patent No.: US 7,219,725 B2
(45) Date of Patent: May 22, 2007

(54) INSTRUMENTED PLUNGER FOR AN OIL OR GAS WELL

(76) Inventor: Christian Chisholm, 4500 Prospect St., Littleton, CO (US) 80123-2772

( * ) Notice: Subject to any disclaimer, the term of this patent is extended or adjusted under 35 U.S.C. 154(b) by 260 days.

(21) Appl. No.: 10/942,337

(22) Filed: Sep. 16, 2004

(65) Prior Publication Data

US 2006/0054329 A1 Mar. 16, 2006

(51) Int. Cl.
*E21B 43/12* (2006.01)
*E21B 33/068* (2006.01)
*E21B 34/16* (2006.01)

(52) U.S. Cl. ..... 166/68; 166/54; 166/107

(58) Field of Classification Search ..... None
See application file for complete search history.

(56) References Cited

U.S. PATENT DOCUMENTS 4,291,761 A 9/1981 Watson
4,664,602 A 5/1987 Gordon
6,170,573 B1 * 1/2001 Brunet et al. ..... 166/153
6,241,014 B1 6/2001 Majek et al.
6,464,011 B2 10/2002 Tubel
6,634,426 B2 10/2003 McCoy et al.

* cited by examiner

*Primary Examiner*—Zakiya W. Bates
(74) *Attorney, Agent, or Firm*—Leyendecker and Lemire, LLC; Kurt Leyendecker

(57) ABSTRACT

A plunger for use in a plunger lift system of an oil or natural gas well includes one or more sensor assemblies, each including one or more sensors for measuring various physical and operational conditions during the operation of the well. The data acquired from the sensors is stored in memory within the sensor assemblies and downloaded to the plunger lift system controller when the plunger is located in the catch/lubricator. The data can then be analyzed by the controller or other computer to vary the well's operating parameters to maximize the well's operating efficiency and the data can be used in reservoir management, such as transient testing, reservoir modeling and interference testing.

11 Claims, 9 Drawing Sheets

INSTRUMENTED PLUNGER FOR AN OIL OR GAS WELL

FIELD OF THE INVENTION

This invention generally relates to plunger lift systems used with oil and gas wells. More particularly, this invention pertains to a plunger including instrumentation or other electronics contained therein for acquiring data concerning one or both of the operation of the plunger and physical conditions in the well bore and reservoir.

BACKGROUND

When a well is first drilled and put into operation, the reservoir pressure in the well is generally sufficient to cause oil and/or gas contained in the well to rise to the surface where it is collected and stored. As the well ages and more wells are placed into a common basin, the well's ability to maintain the pressure necessary to continuously pump oil and/or gas declines due to natural pressure depletion. Once the reservoir pressure is no longer sufficient to permit continuous pumping, a well operator must either install an artificial lift system or cap the well. If a sufficient reserve of oil or gas remains in the reservoir, capping the well may not be economically desirable.

One method of artificial lift is to place a pump in the well to mechanically pump the oil and/or water from the well. However, this can be a very expensive proposition not only requiring an operator to install a pumping system, but also to provide a source of power to run the pump. As can be appreciated, many wells are located in remote locations where sources of energy are not easily or inexpensively recovered. Typically, mechanical pump lift systems are only utilized on wells where the volume of the reserve accessible by the well is considerable enough to justify the expensive of fitting the well with the expensive pumping system and to justify the increased operational expenses.

For wells that are not amenable to a mechanical pumping lift system, a plunger lift system is often used. Plunger lift systems are passive in that they do not rely on an external power source for their operation. Rather, they utilize any remaining well reservoir pressure combined with the well's ability to re-pressurize when the valve connecting the well to the collection tanks or flowline is closed.

Plunger lift systems are generally inexpensive to purchase, as well as, operate compared to alternative types of artificial lift systems. External power is required only for the operation of a small number of solenoids, valve motors and the system's electronic controller. The power levels are low enough that only a small battery pack is necessary.

A well 10 outfitted with a typical plunger lift system is illustrated in FIG. 1. The well comprises a borehole 12 that extends from the subterranean surface to a reserve of oil and/or natural gas. The borehole comprises a tubing string 14 that is encircled by casing 16. The tubing string is comprised of a plurality of tubes interconnected by collar joints (not shown) at their respective ends. A plunger 44 is located in the tubing and is adapted to move freely upwardly and downwardly between the wellhead 18 and the well bottom 20. A bumper 22, most commonly a coil spring, is located at the well bottom to stop the plunger as it completes its descent.

A typical Christmas tree 24 of a plunger lift outfitted well includes a lubricator/catcher 26 that stops the upwardly ascent of the plunger. An arrival sensor 28 is provided at the base of the lubricator/catcher to sense the arrival of the plunger and activate a catcher solenoid 30 to hold the plunger in place until selectively released to travel back to the well bottom. In other variations, a spring-loaded catch arm (not illustrated) is biased into the interior of the lubricator/catcher at its base to catch and hold the plunger once it passes the arm, wherein a plunger solenoid attached to the arm pulls it back and out of the interior to release the plunger. In another variation, it is not necessary to catch the plunger at the surface as the plunger is held in the lubricator until the pressure level dissipates and the plunger falls back to the bottom. Additionally, in this variation shutting a flow line valve will also cause the plunger to fall. A flow line 32 is in operable fluid communication with the tubing string 14 and the solenoid-operated (or motor-operated) flow valve 34, which when opened permits the flow of oil and/or gas to storage tanks (not illustrated) or pipeline (not illustrated). A pressure sensor 38 is also provided to measure the pressure level within the casing.

The arrival sensor 28, the plunger solenoid 30, the flow valve 34 and the pressure sensor 38 are all electronically coupled with a controller module 40. Based on input from the pressure sensor and other sensors and/or the travel time of the plunger, the controller may catch or release the plunger and opens or closes the flow valve to control the lifting of oil and gas out of the well. If no power source is readily available, a solar panel 42 and a battery pack (not illustrated) can be provided to power the controller and the various solenoids and sensors.

FIG. 2 (prior art) is an isometric view of a typical plunger 44. There are many different types of plungers depending on a particular design application and engineering variable concerning the well and any debris or contaminants that might be found in the well. Generally, a plunger is an elongated primarily metallic cylinder or rod that has an outside diameter only slightly smaller than the internal diameter of the tubing string 14. The illustrated plunger generally comprises a plurality of annular wiper ridges 50 that are spaced along most of the plunger's length. The ridges help scrape sand and scale not to mention paraffin and other debris from the sidewalls of the tubing string during the plunger's ascent and descent. Other types of plungers (not illustrated) can have, but are not limited to, (i) smooth outside diameter surface, (ii) spring-loaded metal plates that contact the surface of the tubing string's interior wall, and/or (iii) a segment made of bristles that scrape the tubing string's interior wall. Further, plungers can be flexible to permit them to negotiate around non linear portions of the tubing string during their journey.

A plunger can be solid or it can have a hollow interior. The illustrated plunger is of the hollow variety having an at least partially open bottom end 52 and a plurality of small holes 54 extending inwardly to the interior 56 from between the annular ridges 50.

Some plungers also include a valve at the top of the interior that is in fluid communication with the plunger's topside and that permits the gas and fluids to pass freely through the interior of the plunger when it is open. The valve is opened as the plunger is released from the lubricator/catcher 26 and facilitates the rapid descent of the plunger down the well. When the plunger impacts the bumper 22 at the well bottom 20, the valve closes.

At the top of the illustrated plunger, a fishing neck 58 is shown. The fishing neck permits the well operator to easily retrieve the plunger should it become stuck in the tubing string 14. An operator snakes a wire line with a suitable clamp member down the well to couple with the fishing neck and permit the plunger to be pulled free. As can be appreciated, having to pull tubing to remove a stuck plunger from a well results in downtime that the well could otherwise be producing. The build up of paraffin and other debris, especially around tubing collar joints, can build up over time and can eventually cause a plunger to become stuck. If the operator can determine that there is a debris buildup, an operator would swap out the plunger with a cleaning plunger, such as a brush plunger, to clean the tubing string rather than risk significant downtime if and when the plunger becomes stuck.

Prior art FIG. 3 is a flow chart indicating the operation of controller of a typical plunger lift system equipped well. Once the pressure level in a gas or oil well has dropped to a level that no longer supports the extraction of the oil and/or gas as measured by a pressure sensor 38, the flow valve 34 is closed as is indicated by block 100 and the catcher solenoid 30 may be activated, if necessary, to free the plunger 44 from the lubricator/catcher as indicated in block 105. The plunger descends down the borehole 12 until impacting the bumper 22 and coming to rest at the well bottom 20.

While the plunger 44 is resting on the well bottom 20, pressure in the well increases and is monitored. In an oil well, oil accumulates in the well and percolates past the plunger to fill a portion of the tubing 14. This oil is lifted out of the well when the plunger ascends to the surface. In a primarily gas well, liquids (typically condensate and water) accumulate above the plunger and the casing causing a liquid loading condition. If the liquids are not removed from the tubing string 14, the well can become "loaded up" and cease to produce due to excessive hydrostatic head.

Once sufficient time has elapsed, the pressure in the well reaches a suitable level as measured at the wellhead 18 by the pressure sensor 38, the controller opens the flow valve 34 as indicated in block 115. Almost immediately a pressure differential is established between the portion of the tubing string 14 above the plunger 44 and the region below the plunger causing the plunger to be propelled upwardly carrying any liquid located above the plunger with it. Accordingly, the liquid is moved into the flow line 32 for storage or disposal. Once the plunger passes the arrival sensor 28, it is held in the lubricator/catcher 26 (i) through the activation of the catch solenoid 30, (ii) by way of the spring-loaded catch arm, or (iii) by gas pressure from below as indicated in block 120.

Generally, the plunger will remain in the lubricator/catch as long as the well continues to produce. The controller 40 will monitor the pressure in the well via the pressure sensor 38 as indicated in block 125. Additionally, if the well is equipped with a flow sensor, the flow rate in the flow line 32 can also be monitored. After a certain period of time has passed, however, the pressure in the well and the flow rate will drop to a level that will not support extraction of oil and/or gas and the controller will shut the flow valve 34 releasing the plunger again to repeat the process.

SUMMARY OF THE INVENTION

In a first aspect of the present invention a plunger adapted for use with a well is described. The plunger comprises (1) a substantially cylindrical body, and (2) one or more sensor assemblies coupled with or at least partially contained within the body. The one or more sensor assemblies are configured to monitor one or more of the group of (i) temperature, (ii) pressure, (iii) plunger load, (iv) plunger acceleration, (v) plunger velocity, and (vi) plunger position.

In a second aspect of the present invention another plunger adapted for use with a well is described. The plunger comprises (1) a substantially cylindrical body, (2) at least one memory storage device, (3) at least one data controller, and (4) at least one data transfer device coupled with the at least one data controller. The at least one data controller is both coupled with the at least one memory storage device and adapted to manage the flow of data in and out of the at least one memory storage device. The at least one data transfer device is adapted to facilitate the flow of data between the plunger and an external device.

In a third aspect of the present invention a control system of a plunger lift equipped well wherein the well includes (i) a tubing string that extends down a borehole, (ii) a plunger adapted to ascend and descend between a well head and a well bottom in the tubing string, (iii) the well head, (iv) a plunger lubricator/catch adapted to periodically hold the plunger above the well head and (v) a flow line in fluid communication with the tubing string via the well head is described. The plunger includes one or more sensor assemblies for monitoring and recording data concerning physical conditions in the tubing string. The one or more sensor assemblies include an output interface and a power supply. The control system comprises (1) a controller, (2) a flow valve operatively coupled to the controller and in operative communication with the flow line, (3) one or more pressure sensors operatively coupled to the controller located at or proximate an associated well head, and (4) a input interface operatively coupled to the controller adapted to couple with the output interface of the plunger and receive data therefrom. The flow valve is adapted to open or close responsive to signals from the controller. A plunger release mechanism is operatively coupled to the controller. The plunger release mechanism is adapted to release the plunger from the lubricator/catch.

In a fourth aspect of the present invention, a method of operating a plunger lift equipped well is described. The method comprises (1) sending plunger to a lower portion of the well by one or both of the operations comprising (i) closing a flow valve, and (ii) releasing the plunger from a lubricator/catch, (2) monitoring and storing data at the plunger while the plunger is at least one of the group of (a) descending down the well, (b) ascending up the well and (c) resting on the bottom of the well, (3) sending the plunger to the lubricator/catcher by opening the flow valve after a predetermined level of pressure has been reached in the well, and (4) transferring the data from the plunger to the controller while the plunger is at least partially contained in the lubricator/catch.

DETAILED DESCRIPTION

Figure 1:
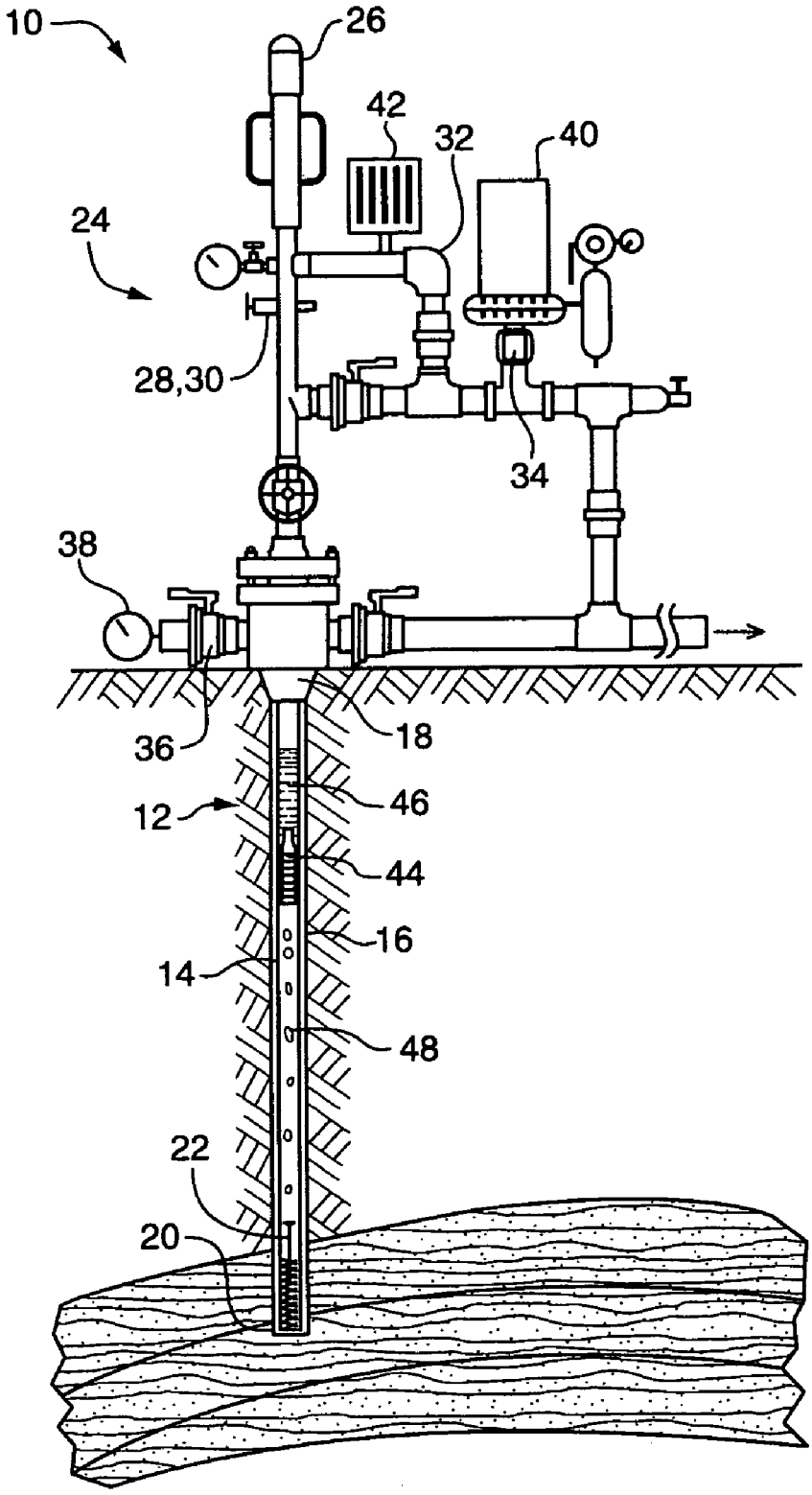
FIG. 1 PRIOR ART
FIG. 1 (Prior Art) is depiction of a typical well incorporating a plunger lift system.

One embodiment of the present invention comprises a plunger used in the artificial lift of oil and gas wells that includes one or more sensor assemblies. The sensor assemblies are capable of monitoring and recording data about the conditions in the well's tubing string and/or casing such as, but not limited to, temperature, pressure, fluid type, acceleration, velocity, location and load on the plunger during its ascent and descent. The data can be monitored and recorded periodically or continuously throughout the cyclical operation of the plunger.

In preferred variations of the one embodiment, the data are transferred (or downloaded) to a controller or other data repository when the plunger is held in the lubricator/catcher in the christmas tree either through mechanical contacts or a wireless transmission means. In other variations, the sensor assembly is periodically removed from the body of the plunger, operatively coupled with a controller, computer or other device, and the data are transferred to the controller, computer or other device.

Advantageously, an operator can use the data to vary the operating parameters of the plunger lift system to maximize the well's lift efficiency. In certain variations, the controller of the plunger lift system can run a program that analyzes the data from the plunger and makes adjustments to the operating parameters based on the data. For example, an accelerometer sensor in the plunger may indicate the fluid level above the plunger. Liquid level is critical in determination of the casing set point pressure necessary for efficient operation of the plunger and liquid removal from the well bore. In addition, an operator can use the pressure data acquired from the plunger to help calculate parameters such as, but not limited to, permeability, reservoir life, well-to-well interference effects. Analysis of these parameters can be used to optimize production not only for a single well but for an entire oil or gas reservoir comprising multiple wells.

Currently, in prior art plunger lift systems, there is typically no convenient manner for determining pressure and temperature data from deep within the well. Pressure sensors can be run down the tubing string, but such an implementation requires electrical wire and its associated wire line housing to be extended downwardly thousands of feet. As indicated by the test results provided herein, the conditions in the tubing string can be different than the conditions in the casing. Pressure and temperature can be measured in the tubing string using prior art methods by removing the plunger and running a sensor equipped wire line down the tubing string. Of course, since the well is not in operation, the conditions measured aren't necessarily indicative of the conditions that exist when the plunger is being used and the well is in flowing cyclical operation. Typically, the data obtained from the plunger lift is indicative of the conditions within the reservoir.

At least one prior art reference describes acoustically monitoring the tubing string and listening for characteristic sounds as the plunger passes the tubing string collar joints. Since the distances between collar joints are generally fixed, the velocity can be determined. Further, acceleration can be determined analytically by noting changes in velocity between the collars. Accordingly, acoustic monitoring does provide valuable information to a well operator, but the data is not particularly precise especially if the length of the tubing between collars varies anything but a small amount. Further, acoustic monitoring does not provide data concerning acceleration variations between tubing collars while the plunger is in liquid. Finally, acoustic monitoring does not provide any information concerning the temperature and pressure in the region of the plunger as it is ascending or descending in the tubing string.

The advantages of the embodiments described herein above and below along with the particular configuration of the described embodiment(s) of the invention are not conclusive or even exhaustive but rather merely representative of the best mode of using the invention. Rather, numerous variations and other embodiments have been contemplated that read upon the appended claims and are, accordingly, intended to be within the scope of the invention.

Terminology

The term "or" as used in this specification and the appended claims is not meant to be exclusive rather the term is inclusive meaning "either or both".

References in the specification to "one embodiment", "an embodiment", "a preferred embodiment", "an alternative embodiment", "an aspect" and similar phrases mean that a particular feature, structure, or characteristic described in connection with the embodiment or aspect is included in at least an embodiment or aspect of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

As used herein, the term "inducer" refers to any device, such as but not limited to an induction coil, that is (i) specifically configured to generate current flow in the presence of a pulsing electromagnetic field, or (ii) specifically configured to generate a magnetic field when current is passed therethrough.

As used herein, the term "lubricator/catch" refers to any device adapted to selectively hold and contain the plunger above the wellhead unless specifically indicated otherwise.

As used herein, the term "plunger" refers to any device adapted to freely move within a casing or tubing string of a well and ascend from proximate the well bottom to proximate the wellhead based on a pressure differential between top and bottom ends of the plunger.

The phrases, "wireless receiver", "wireless transmitter" and "wireless transceiver" are not limited to a particular technology or manner of wireless data transfer unless specifically indicated otherwise herein.

As used herein, the term "tubulars" as used herein refers to both tubing strings and casing strings. It is appreciated that certain wells can be operated without a tubing string with a plunger running directly against the interior diameter of the casing.

As used herein, the term "shuttle" refers to any device that can be placed on the bottom of a well (or at any particular location along the length of the well) and will remain in place until retrieved.

A Plunger According to One Embodiment

Figure 4:
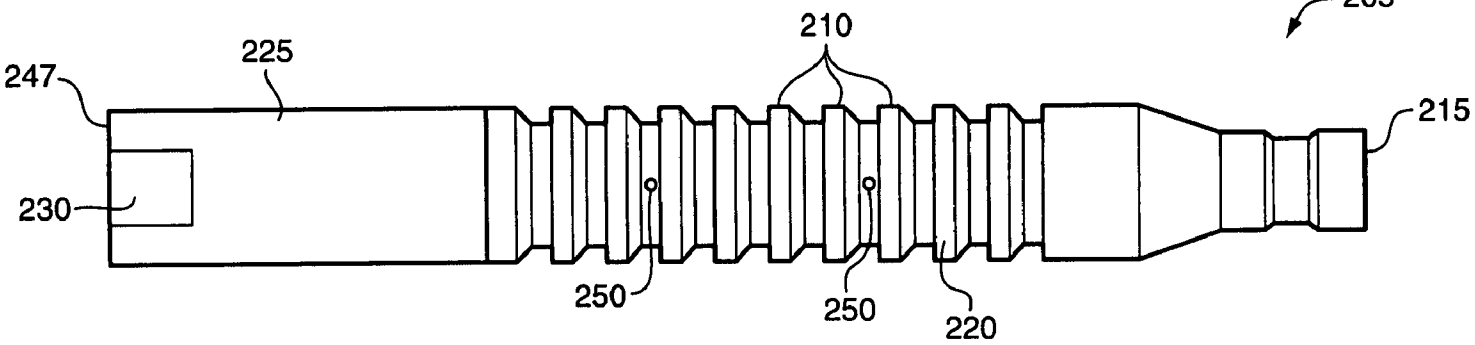
FIG. 4 is an isomeric side view of a plunger according to one embodiment of the present invention.
Figure 5:
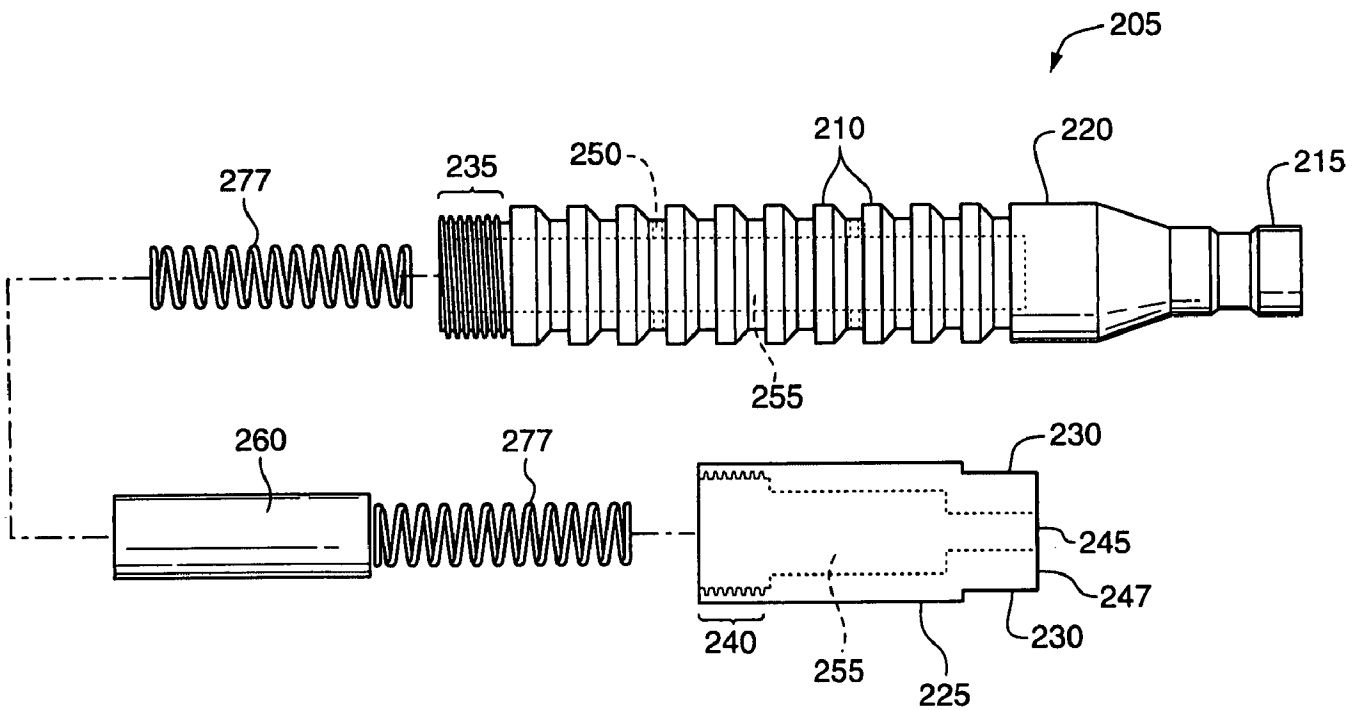
FIG. 5 is an exploded isometric view of the plunger with two sensor assemblies contained within its interior according to one embodiment of the present invention.

A plunger 205 according to one embodiment is illustrated in FIGS. 4-5. The plunger is adapted to ascend and descend along a tubing or casing string of a plunger lift system equipped well. In general, instrumented plunger system equipped wells according to embodiments of the present invention are very similar to the prior art plunger system equipped wells 10 shown in FIG. 1 except in some embodiments and variations there can be (i) differences in the controller, and (ii) the addition of a data transfer device (i.e. a wireless receiver and/or electrical contacts) at the lubricator/catcher to interface with the plunger.

Generally, the exterior of the plunger has several similarities with the prior art plunger described above with reference to FIG. 2. Namely, the exterior surface can include a plurality of wiper ridges 210 and a fish neck top section 215. Alternatively, the surface of the plunger 205 can be of any suitable configuration known in the art including, but not limited to, smooth, a bristle brush section, and an expanding blade section. In other variations the fish neck can be omitted. Simply, the exterior configuration of the one embodiment is not limited.

The one embodiment plunger comprises top and bottom sections 220 & 225 that are coupled together to form a hollow interior 255 of the plunger in which one or more sensor assemblies 260 can be placed. As illustrated, the top section 220 includes a threaded male portion 235 and the bottom section 225 includes a corresponding female threaded portion 240. Wrench flats 230 are provided on the bottom section 225 of the bottom section to facilitate the unscrewing of the sections. While the top and bottom sections are coupled using threaded portions in FIG. 5, the two sections can also be coupled in other suitable manners, such as using one or more screw or bolts or corresponding keys and keyways on the respective sections.

The plunger includes an opening 245 at its bottom end 247 and various holes 250 extending from between the wiper ridges generally radially into the hollow interior compartment to permit oil, gas, water and other fluids and gases to pass therethrough. Accordingly, the physical conditions, such as temperature and pressure, inside the plunger are essentially the same as the conditions immediately on the outside of the plunger.

One or more sensor assemblies 260 may be received into the hollow interior 255. The sensor assemblies are typically configured to measure and record data relating to any number of conditions that may be useful to a well operator. For instance, sensor assemblies can be used that measure position, temperature, pressure, fluid-type, acceleration, load and velocity. In variations, sensor assemblies can be substituted for samplers that sample the fluid or gas in the bottom of the well.

Figure 6:
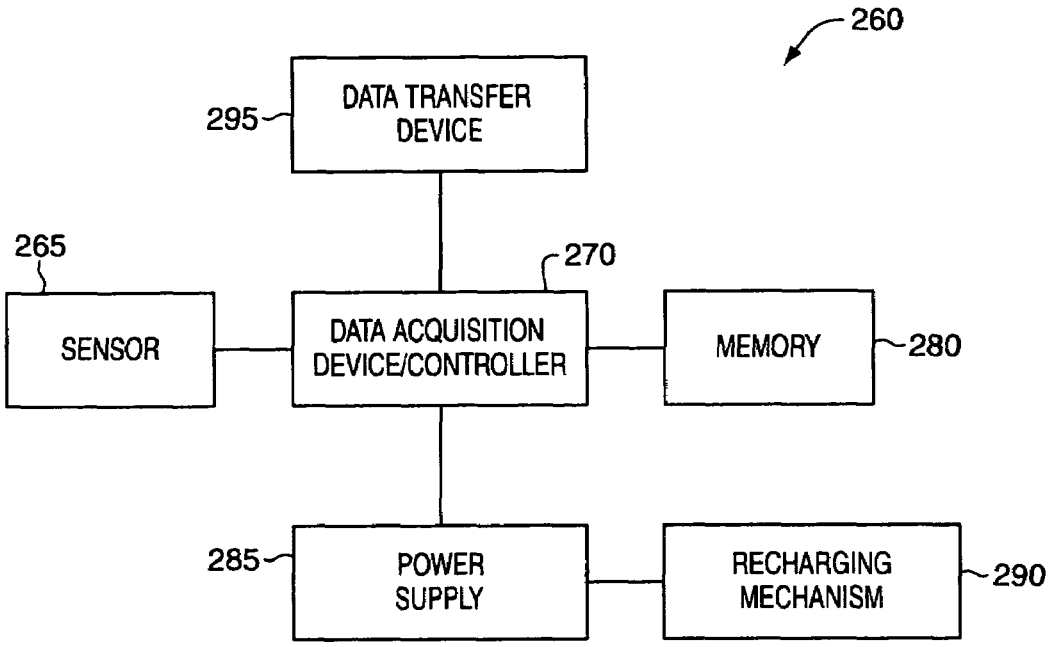
FIG. 6 is a block diagram indicating the configuration of a plunger sensor assembly according to one embodiment of the present invention.

As illustrated in FIG. 5, the sensor assembly 260 is generally a self-contained unit. Coil springs 277 are placed on either end of the sensor assembly to cushion it from the shock of rapid deceleration as the plunger either is caught in a lubricator/catcher 26 after its ascent or it impacts a bumper 22 in a well bottom 20 after its descent. FIG. 6 is block diagram illustrating the components of a typical sensor assembly. All the components must be capable of withstanding the elevated temperatures and pressures common in gas and oil wells not to mention the G-forces generated during the plunger's rapid deceleration. The assembly typically includes a sensor 265 adapted to measure a particular condition related to the well and/or the plunger. Suitable sensors adapted to the physical conditions of oil and gas wells are made by various manufactures, such as Endevco, Inc., Motorola, Inc, Druck, Inc., and Honeywell, Inc. and are well known in the art.

A data acquisition device 270 or controller may be coupled to the sensor 265. The data acquisition device is further coupled to a memory module 280. Operationally, the data acquisition device typically drives the sensor to sample the conditions relating to the particular type of sensor on a periodic basis. The data acquisition device then receives the signal relating to a particular measurement and stores that data in the memory module.

A power supply 285, typically a battery, is coupled to data acquisition device 270, the memory 280 and the sensor 265. The battery can be rechargeable and a recharging mechanism 290 (recharging interface) can be provided. In one variation, the recharging mechanism comprises an inducer that generates an electrical current in response to a pulsating magnetic field to recharge the battery. In another variation, a recharging interface simply comprises a set of electrical contacts situated on the surface of the plunger 205 that couple with corresponding contacts located in the catch/lubricator 26.

In certain embodiments of the sensor assembly 260, a data transfer device 295 is provided. In one variation, the data transfer device comprises a wireless transmitter that transmits data from the sensor assembly to a wireless receiver that is coupled with the plunger lift system's controller. In another variation, the data transfer device can comprise a set of electrical contacts that are coupled with the data acquisition device or the memory module that couple with corresponding contacts in the lubricator/catcher 26 to facilitate the transfer of data to the plunger lift system's controller.

The wireless transmitter can operate on any suitable electromagnetic wavelength including commonly utilized radio frequencies, such as but not limited to 49 MHz, 900 MHz, 2.4 GHz, 5.8 GHz, the AM bands and the FM bands. It is to be appreciated that given the relatively low power of the battery-powered sensor assembly coupled with the inability of most wireless devices to transmit through hundreds of feet of earth, a wireless connection between the plunger and an associated receiver can usually only be made when the plunger is above ground and within a short distance from the receiver. However, improvements in wireless technology may eventually make transmission of data along a substantial portion of the well's length possible.

In one embodiment of the present invention, the wireless transmitter utilizes induction to transfer data between the sensor assembly and a wellhead/surface receiver. By sending pulsing current through an inductor comprising the data transfer device 295, a pulsating magnetic field is generated. By modulating one or all of the amplitude, phase and duration of the pulsing current, the data from the memory 280 is transmitted in the magnetic field. An electrical current is generated in the receiver, which also comprises an inductor, based on the variances in the magnetic field and the resulting pulsating current; a wellhead surface receiver can decipher the transferred data.

Since in at least one embodiment of the sensor assembly 260, induction is used to both transfer data from the sensor assembly wirelessly and recharge the battery in the sensor assembly, the same inductor in the sensor assembly can be used to accomplish both tasks. In other embodiments two separate inductors can be used.

In some embodiments of the plunger 205 and sensor assembly 260, no recharging mechanism/interface 290 is provided and no means for transferring the data directly to the controller is provided. Rather, the sensor assembly simply stores the data it gathers in memory 280 until the sensor assembly has been removed from the plunger and is hooked up to a computer by way of a USB interface, for example, to download the data. Presumably, while the sensor assembly is apart from the plunger the batteries can be either charged or replaced as well. While this particular type of plunger and sensor assembly combination does not necessarily facilitate real time data analysis coupled with well operation parameter adjustment, it does provide for the capture of data concerning tubular, plunger, and reservoir conditions that was heretofore unavailable to well operators. This data can be analyzed and studied to improve well operation and efficiency. A plunger with this type of sensor assembly can also be used in any type of well without modifying the plunger lift system controller. Further, such sensor assemblies are available off the shelf as they are currently used in conjunction with wire lines. For instance, one such sensor is the Slimline III pressure and temperature sensor made by Canada Tech Corp. of Calgary, Alberta.

A Plunger According to another Embodiment

Figure 7:
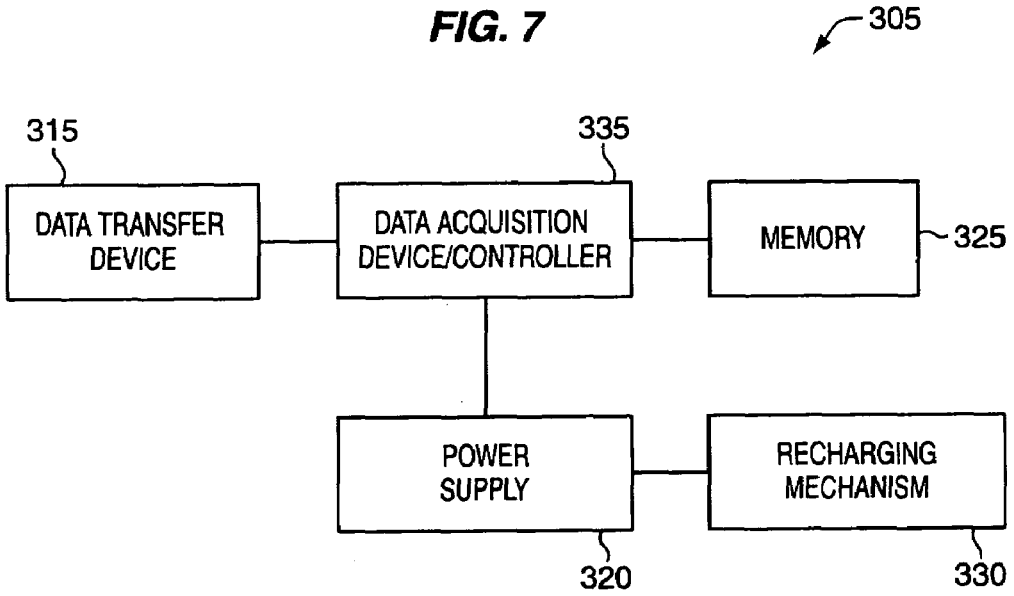
FIG. 7 is a block diagram indicating the configuration of a plunger data acquisition assembly according to one embodiment of the present invention.
Figure 8:
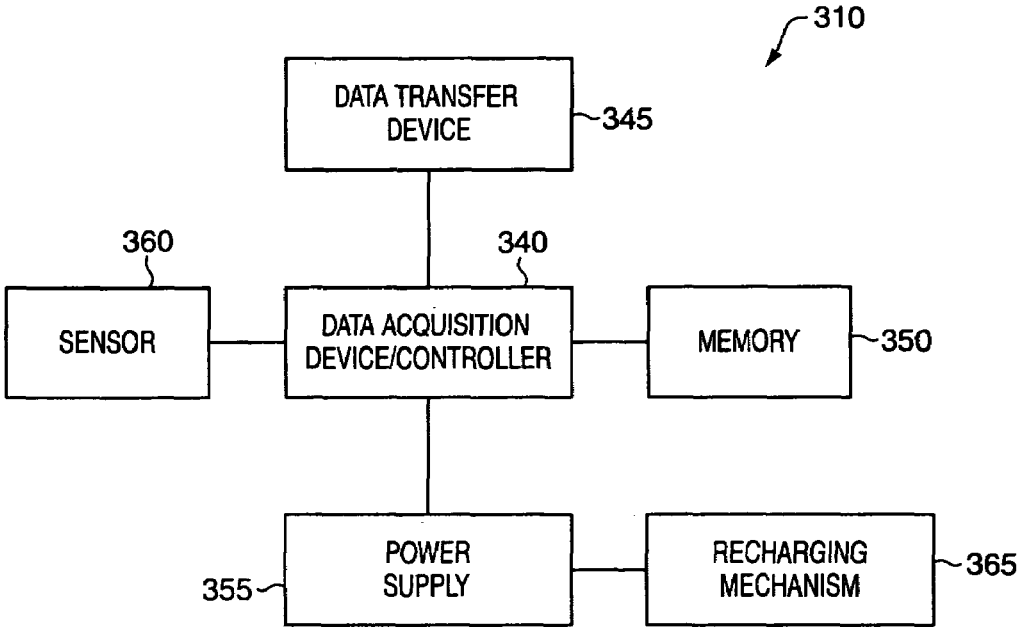
FIG. 8 is a block diagram indicating the configuration of a well bottom sensor assembly according to one embodiment of the present invention.

In another embodiment plunger, the sensor assembly 260 is replaced with a data acquisition and transfer assembly 305 as represented in the block diagram of FIG. 7. The plunger is utilized in combination with a well bottom sensor assembly 310 (see FIG. 8) located at or proximate the bumper 22. A block diagram of a typical well bottom sensor assembly is illustrated in FIG. 8 and described in greater detail below.

The data acquisition and transfer assembly 305 typically comprises a data acquisition device/controller 335, data transfer device 315, a power supply 320, a memory module 325 and a recharging mechanism 330. Although in many respects the data acquisition and transfer assembly 305 is similar to the sensor assembly 260 described above without the sensor(s) 265, there are significant differences. First, instead of a data transfer device 295 comprising just a wireless transmitter, preferred variations of the data transfer device 315 of this embodiment include a wireless transceiver as the assembly 305 is configured to both receive data from the well bottom sensor assembly 310 and subsequently transfer the data to the plunger lift system's controller. In other variations, only a wireless data receiver is provided and the plunger and data acquisition and transfer assembly must be removed from the well to download the data to a computer.

The recharging mechanism 330 of the data acquisition and transfer assembly 305 is preferably able not only to charge its own internal battery power source 320 but also capable of charging the battery power source of the well bottom sensor assembly 310. Accordingly, the capacity of the batteries used in the data acquisition and transfer assembly are typically larger than those used in the sensor assembly 260.

In preferred variations of the data acquisition and transfer assembly 305, inducers are used for both wireless data transfer, as well as, to charge the batteries of both the well bottom sensor assembly 310 and the data acquisition and transfer assembly. However, in other embodiments and variations, sets of electrical contacts situated on the exterior surface of the plunger can be used in place of the wireless data transfer device 315 and the recharging mechanism.

A block diagram representative of a typical well bottom hole sensor assembly 310 is illustrated in FIG. 8. The well bottom hole sensor assembly typically comprises a data acquisition device/controller 340, a data transfer device 345, a memory module 350, a power supply 355, one or more sensors 360, and a recharging device 365. In most respects the well bottom hole sensor assembly is substantially similar to the sensor assembly 260 described above that resides in certain embodiments of the plunger 205. The one or more sensors 265 measure the physical conditions at the well bottom, such as but not limited to pressure and temperature. The sensor(s) are coupled to the data acquisition device 340, which is configured to cause the sensors to take readings periodically and to store the resulting data in the memory module 350. The power supply 355 typically comprising, but not limited to, one or more batteries is electrically coupled with the memory module, data acquisition device and the sensors. Finally, the recharging device 365 and the data transfer device 345 are provided to respectively recharge the battery and transfer data from the memory module to the data acquisition and transfer assembly 305 contained in the plunger when the plunger is resident on the well bottom 20.

One Embodiment of a Well Bottom Shuttle

Figure 11:
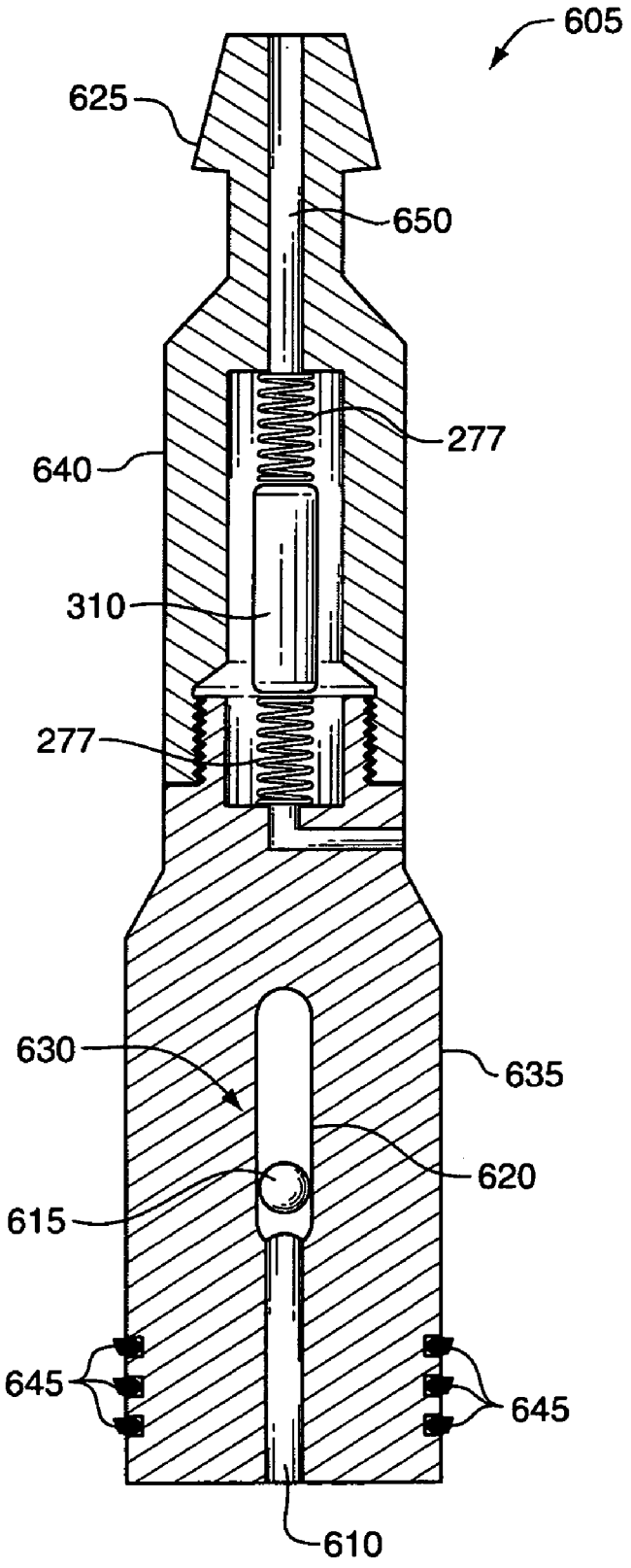
FIG. 11 is an isometric view of a shuttle according to one embodiment of the present invention.

Referring to FIG. 11, a well bottom shuttle 605 is illustrated. The well bottom shuttle differs from a plunger 205 in that it is designed to rest upon the bottom of a well rather than cycle between the well bottom and the well head and is independent of an electric line. The shuttle can also serve as one or both of a bumper and a standing valve. When used as a bumper, a coil spring (not shown) is wrapped about and extends upwardly from the top portion of the shuttle. When used as a standing valve, the shuttle permits liquid to flow upwardly through a bore 610 extending through a lower portion of the shuttle while preventing the liquid from then traveling downwardly through the shuttle. This is typically accomplished using a ball bearing valve 630 comprising a ball bearing 615 that slides freely in slot 620 provided in the shuttle body. Gravity and the weight of the fluid above the ball acts to seal the ball against the bore preventing the downwardly flow of liquid, but the ball moves freely upwardly when the pressure beneath the ball is greater than that above it to allow liquid to flow upwardly through the shuttle.

Because (i) the fluid can flow through the shuttle to equalize the pressure on either end thereof and (ii) the shuttle is seated in a seating nipple (not shown) proximate the end of the tubing string and held in place by elastomeric seals 645 that extend around the outside of a bottom portion 635 of the shuttle, the shuttle does not rise when the flow valve is opened and a pressure differential on either side of the shuttle is created.

Figure 2:
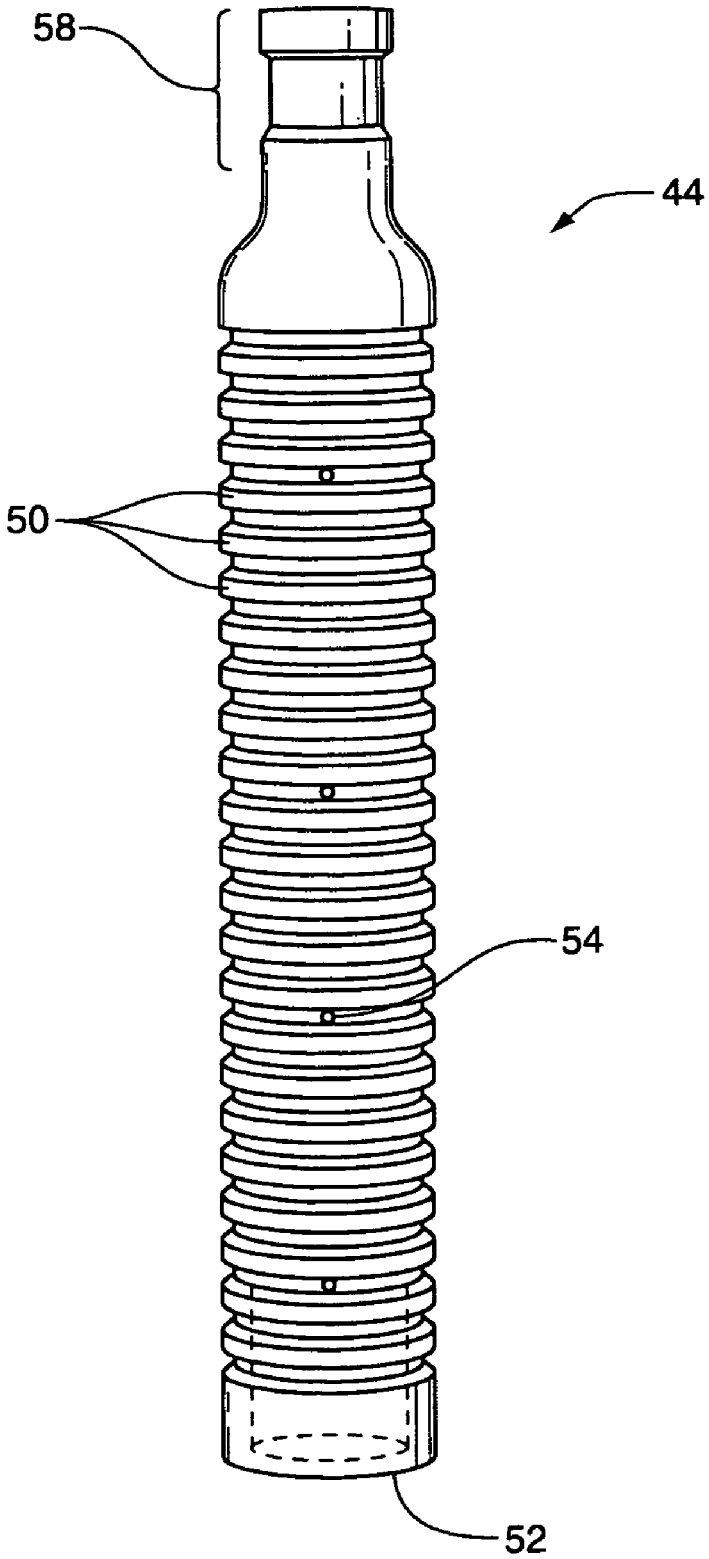
FIG. 2 PRIOR ART
FIG. 2 (Prior Art) is an isometric side view of a typical plunger used in a typical plunger lift system equipped well.

The upper portion 640 of the one embodiment shuttle typically includes a fishing neck 625 similar to the fishing neck 58 & 215 of the plungers illustrated in FIGS. 2 & 5. It is by way of the fishing neck that the shuttle is seated and retrieved from the well's bottom typically using a wire line.

In other variations of the shuttle, the top portion may be separable from the bottom portion seated in the seating nipple such that the top portion containing one or more sensor assemblys 310 can be retrieved using a specially-configured plunger (not shown) with an appropriately configured female bottom end that mates with the shuttle's fishing neck.

In the one embodiment, the shuttle 605 includes a well bottom sensor assembly 310 that is contained therein. The well bottom sensor assembly can be contained in a compartment in either the upper or lower portions of the shuttle on either side of the ball bearing valve 630 and slot assembly. Passages 650 are typically provided into the compartment to permit fluid to pass therethrough. The compartment in which the sensor assembly resides is typically accessed by uncoupling (typically unthreading) sections 635 & 640 of the shuttle. In other variations and embodiments of the shuttle compartments for containing sensor assemblies can be located on either side of the ball bearing valve assembly 630, or on either side of the seals 645. For example, a pressure sensor located in a sensor assembly below the seals would measure the annular casing pressure; whereas, a pressure sensor in a sensor assembly above the seals would measure the tubing string pressure.

In the embodiment of the well bottom sensor assembly 310 illustrated in FIG. 8, the assembly includes a recharging mechanism 365 and a data transfer device 345, both of which interface with a plunger 205 when the plunger is on the well bottom, and recharge the power supply of the sensor assembly 310 and transfer data from the assembly to the plunger's data acquisition and transfer assembly 305 respectively. Accordingly, a shuttle 605 using this well bottom sensor assembly can remain on the well bottom for extended periods of time or even indefinitely.

In other embodiments and variations of the shuttle 605, a well bottom sensor assembly that does not include the recharging mechanism 365 or the data transfer device 345 can be used. In such a variation, the shuttle is left on the well bottom for a predetermined period of time that is ultimately dependant on the size of the memory in the sensor assembly and/or the capacity of the assembly's power supply. To retrieve the shuttle, the specifically configured plunger with the bottom end that mates with the fishing neck is inserted into the well and brings the shuttle to the surface with it. Alternatively, a wire line can be snaked down the well to retrieve the shuttle. Once the shuttle has been removed from the well, the data from the well bottom sensor assembly can be downloaded to a computer and the power supply (typically batteries) can be refreshed before the shuttle is reinserted into the well from which it was removed or another well altogether to continue sampling and recording data.

It is appreciated that the actual configuration of the shuttle 605 can vary significantly from the unit illustrated herein and be comprised of any suitable materials. Operationally, the shuttle can be used in a plunger lift equipped well or any other type of well whether using a mechanical pumping apparatus, being naturally producing or non-producing (wherein the shuttle is used for monitoring purposes).

One Embodiment Plunger Lift Control System

Figure 9:
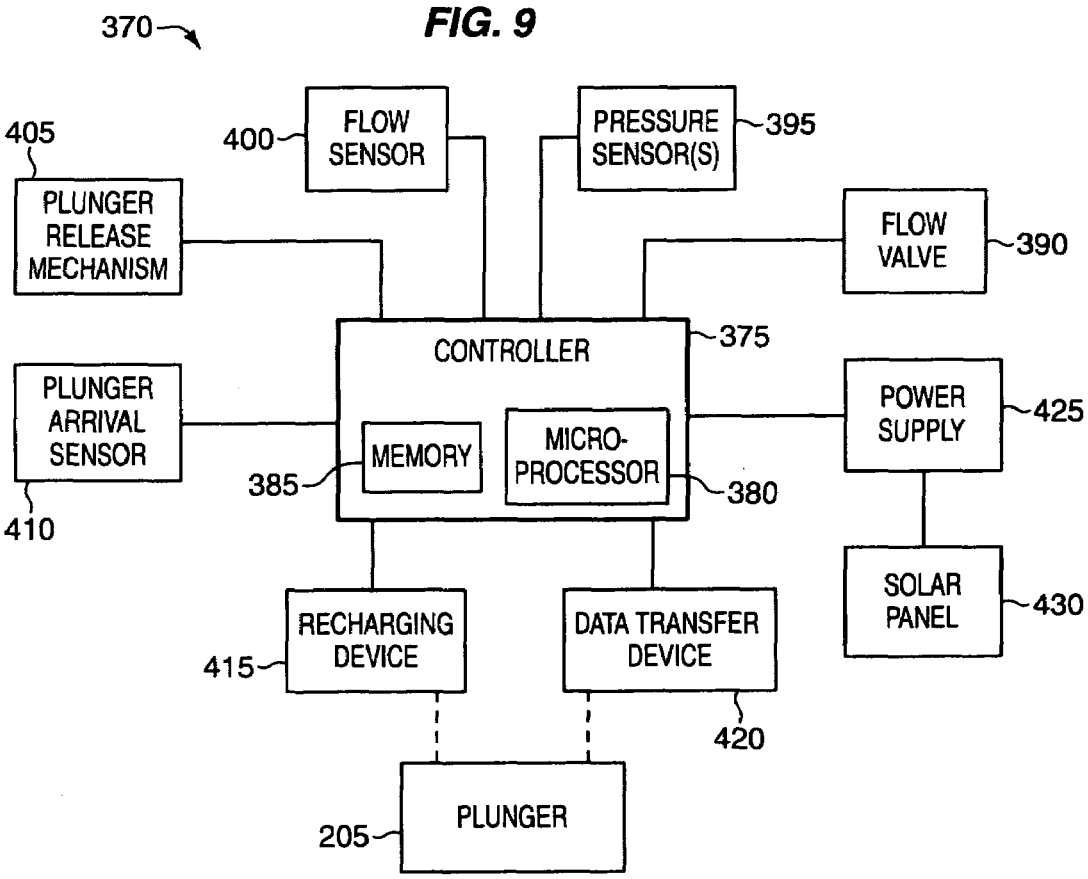
FIG. 9 is a block diagram representing a plunger lift controller system according to one embodiment of the present invention.

A block diagram representing one embodiment of a plunger lift control system 370 that can be used in conjunction with the plunger embodiments described herein is illustrated in FIG. 9. Central to the control system is a controller 375 that typically comprises a microprocessor or CPU 380 and one or more types of volatile or nonvolatile memory 385 to store data, software and the microprocessor's operating system. The controller is programmed to control the various peripherals coupled therewith.

The controller 375 is coupled to a motor or solenoid of the flow valve 390 to open or close the flow line 32 thereby causing oil and/or gas to flow depending on whether a sufficient level of pressure has developed in the well bore. The controller is also coupled with one or more pressure sensors 395 located in the wellhead that measure one or both of the pressures in the casing and the tubing string. Typically, the controller uses the pressure readings of these sensors to determine whether or not to open the flow valve and cause the plunger and any oil or water on top of the plunger to be lifted to the surface.

A flow sensor 400, which is resident in or on the flow tube 32, can also be coupled to the controller 375 to measure the flow rate of gas and/or oil being lifted out of the well. It can further be used to help determine when to close the flow valve and release the plunger 205 from the lubricator/catcher 26 by activating a release mechanism 405 that is also coupled to the controller. Alternatively, the controller can be configured to close the flow valve 390 and release the plunger when the pressure in the well as measured by the pressure sensors 395 drops below a certain level. In other variations, the controller can be configured to close the flow valve soon after the plunger arrives at the lubricator/catcher as indicated by a plunger arrival sensor 410 typically located at the base of the catch/lubricator.

To interface with the sensor assembly 260 of the plunger 205 when it is held in the catch/lubricator 26, the controller 375 is coupled to a recharging device 415 and data transfer device 420 that couple with the corresponding devices in the sensor assembly. In certain variations, the data transfer device can be wireless or can comprise electrical contacts that interface with corresponding contacts on the plunger. In certain preferred variations, the data transfer device includes an inductor to receive data, and either the same inductor or a separate inductor to recharge the batteries in the plunger's sensor assembly.

A power supply 425 is provided and coupled to the controller 375 and its various peripherals. The power supply can comprise batteries when the well is located in a remote location, or when AC current is available it can serve as the power supply. For remote wells, a solar panel 430 may also be provided to recharge the batteries. In other variations, a fuel cell or a generator can be used to provide power.

A Method of Operating a Plunger Lift System According to One Embodiment

Figure 3:
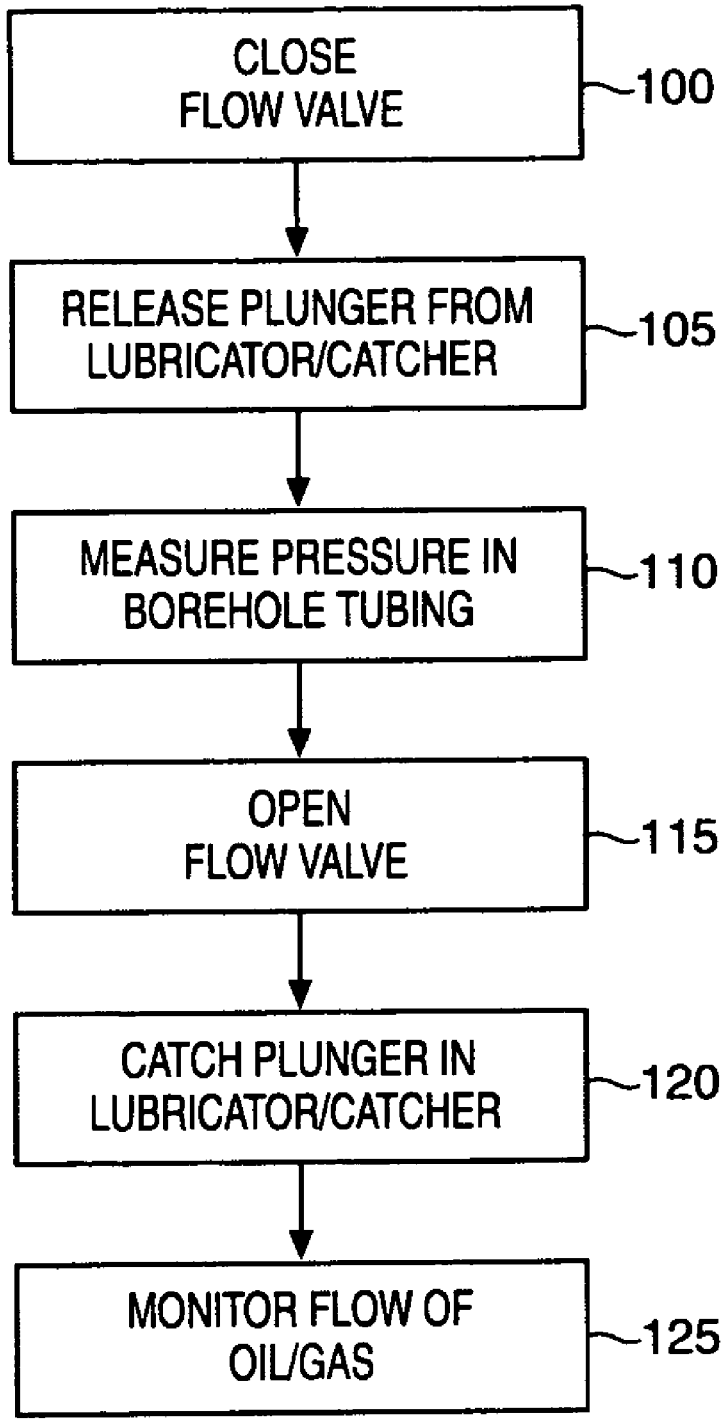
FIG. 3 PRIOR ART
FIG. 3 (Prior Art) is a flow chart concerning the operation of a plunger lift system's controller during a typical lift cycle.
Figure 10:
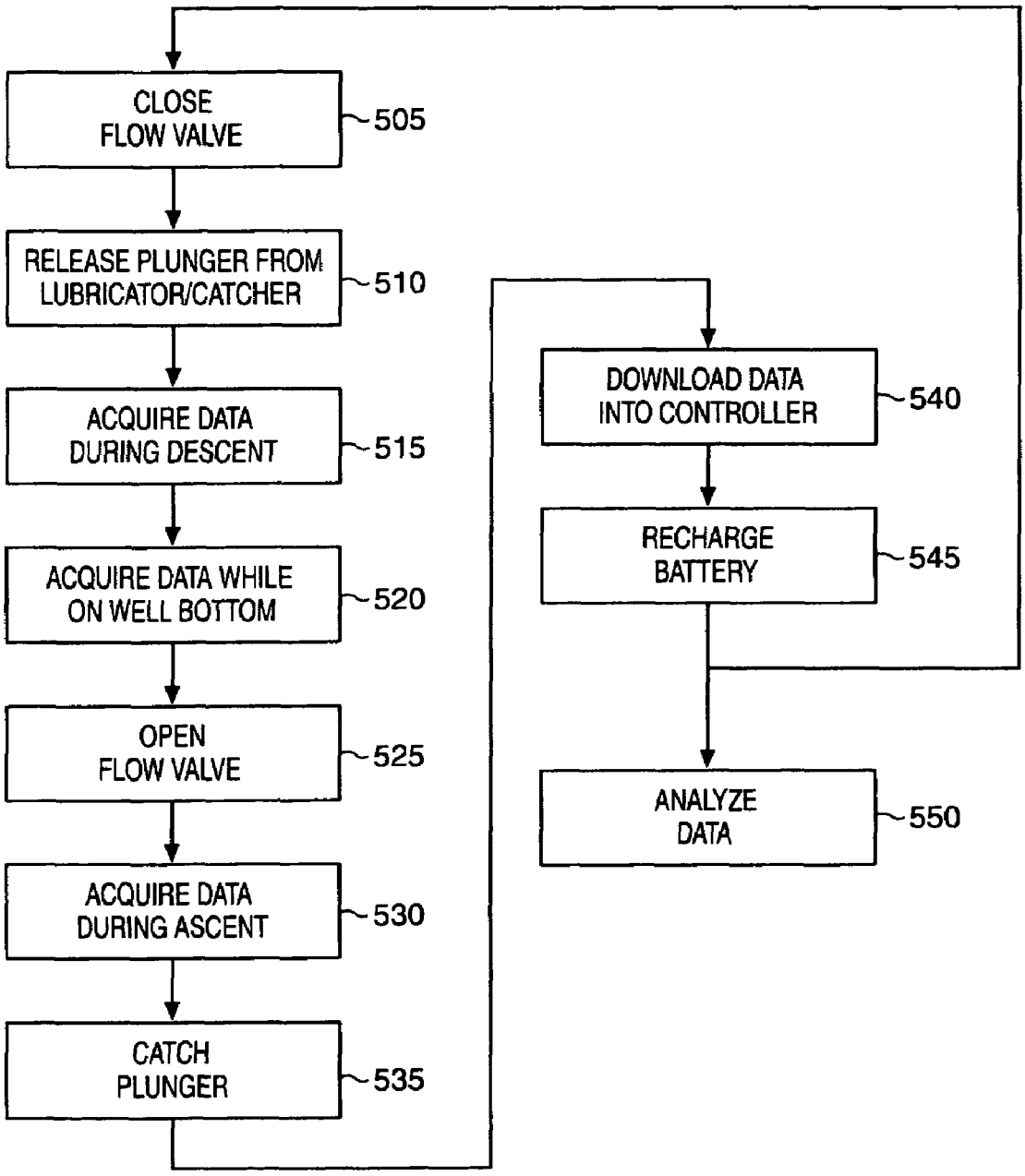
FIG. 10 is a flow chart concerning the operation of a plunger lift system according to one embodiment of the present invention.

A method of operating a plunger lift system incorporating a plunger lift system controller 375 and plunger 205 similar to embodiments and variations described above is provided in the flow chart of FIG. 10. As indicated by blocks 505 and 510, the flow valve 390 is closed and the plunger is released from the lubricator/catcher 26 in a manner substantially similar to the operation of a prior art system as indicated in FIG. 3.

As the plunger 205 descends down the tubing string 14, the one or more sensor assemblies 260 take (or sample) various applicable measurements as indicated in block 515. For instance, position of the plunger can be determined using a proximity sensor. Using this data coupled with the times at which each collar is passed, the velocity of the plunger can also be calculated. In certain variations, the velocities of the plunger can be calculated by the data acquisition device 270 of the sensor assembly using its internal processor, or alternatively in other variations, the position and time data can be downloaded to the controller 375, wherein the controller's processor performs the necessary calculations to determine the plunger's velocity at various points along its descent. Relative acceleration and deceleration values can also be calculated from the data, although more precise data can be obtained using an accelerometer sensor. As discussed above, by knowing how the plunger accelerates and decelerates during its descents and ascents can provide valuable information including, but not limited to, data concerning the state of the tubing string 14 and fluid levels. Additional sensor readings can also be taken during the descent to provide the well operators and the system controller with a picture of the physical conditions along the entire length of the well bore, such as holes in the tubing, friction of the plunger, fluid phases and fluid composition.

Next, as indicated in block 520, the sensor assembly 260 continues to take measurements of the physical surrounding and record the data to memory 280. Some sensor assemblies may include a load sensor that provides data concerning the weight of the liquid as it builds up on top of the plunger 205. This data could be utilized to better determine when to open the flow valve 390. For example, it is possible that instead of opening the flow valve after a certain well pressure has been reached, more efficient lifting could be obtained by allowing the oil to accumulate on top of the plunger for an additional period of time. The accumulation of such load data would permit the adjustment of the controller parameters to take advantage of the specific characteristics of each well.

Once the pressure in the tubing string 14 and/or casing reaches the desired level as determined by the pressure sensor 395 at the well head, the controller 375 opens the flow valve 390 to send the plunger 205 upwardly as indicated in block 525. During the plunger ascent, sensors 265 record and store data concerning the physical conditions during the ascent, as well as, parameters relating to the velocity and acceleration of the plunger as indicated in block 530. As shown in block 535, the plunger is received and caught in the lubricator/catcher 26 once it reaches the top of the well.

While the plunger 205 is in the catch/lubricator 26, the data from the sensor assembly 260 is downloaded to the controller 375 and the batteries in the sensor assembly are at least partially recharged as indicated in blocks 540 and 545. The whole cycle repeats once the pressure in the tubing string 14 and/or casing reaches the predetermined level.

In certain plunger lift well systems as indicated in block 550, the data obtained from the plunger's sensor assembly 260 are analyzed by the controller 375 along with data obtained from the flow sensor 390 and the well head pressure sensors 395 and the results are used to adjust the operating parameters of the plunger lift system and/or to alert the well operators to conditions in the well that could use attention, such as a hole in the tubing string 14. Further, if the controller is networked, the data can be downloaded to a central database where it can be analyzed along with the data from other wells to further maximize the operation of a particular well or an entire group of wells.

Figure 12:
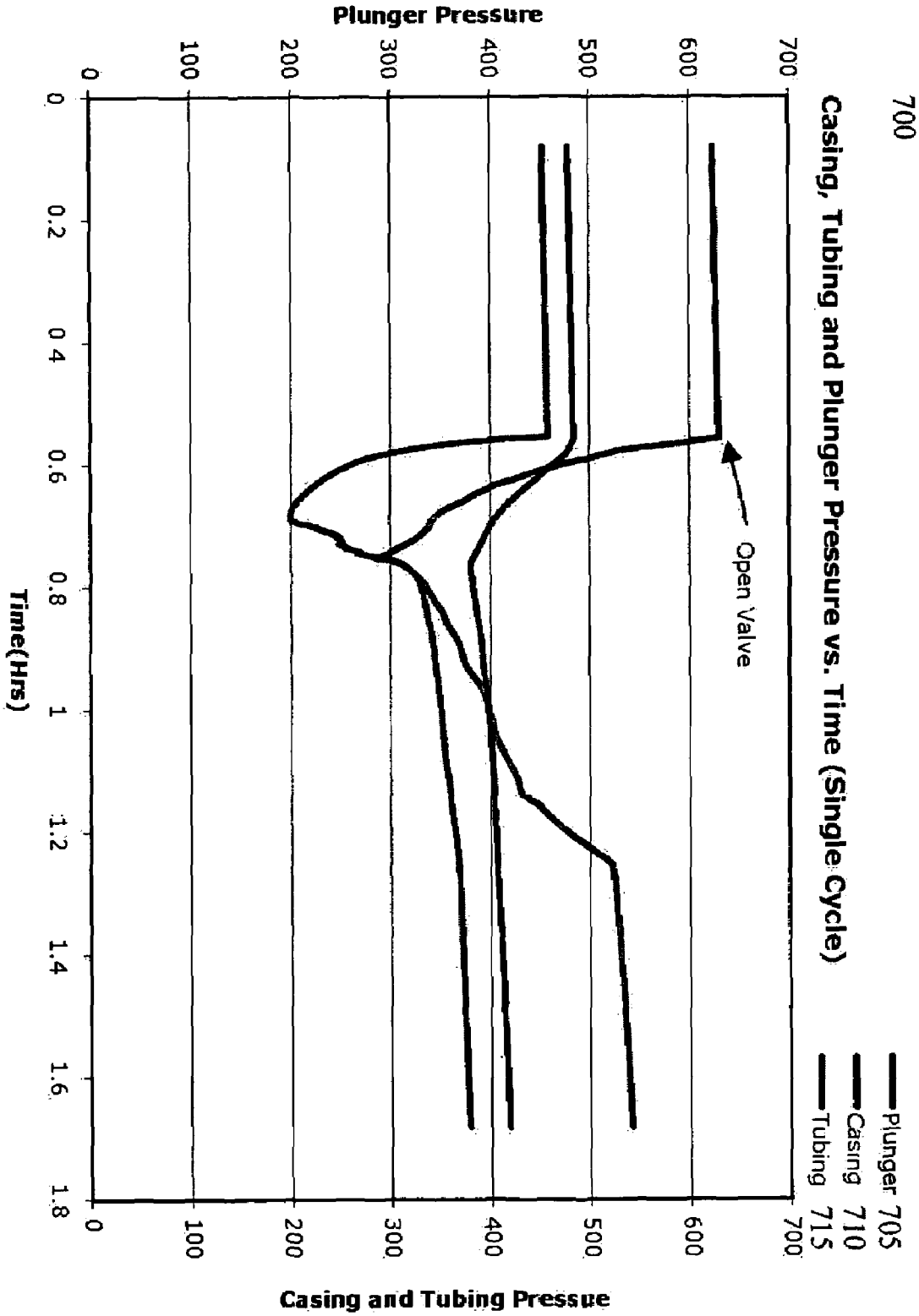
FIG. 12 is a time v. pressure plot illustrating the pressure levels measured by pressure sensors located proximate the well head that measure casing and tubing string pressure and a pressure sensor located in the plunger.

Test Results: Plunger Pressure and Temperature v. Casing and Tubing Measurements Referring to FIG. 12, a typical plot of pressure as measured in the casing (line 705), the tubing string (line 710) and at the plunger (line 715) is illustrated. A plunger similar to the one illustrated in FIGS. 4 & 5 utilizing a self contained Slimline III pressure sensor assembly manufactured by Canada Tech Corp. of Calgary, Alberta was used. After numerous cycles were performed, the plunger was removed from the well and the assembly was removed from the plunger. The data from the sensor assembly was downloaded to a computer and graphed.

Although analysis of the representative plot is beyond the scope of this document, a quick glance at the plot reveals that the pressure conditions as recorded by the plunger's sensor assembly are significantly different from the casing and tubing string pressures recorded at the same time at the well head. By analyzing the data and determining the significance of the difference in the pressure values, changes in the operating parameters of the well from which the data were obtained could be determined that would increase the cycling rate and ultimately the well's productivity.

Other Embodiments and other Variations

The various preferred embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For example, a plunger can include several sensor assemblies instead of the single assembly illustrated in FIG. 5. Further, a single assembly can include a plurality of sensors to measure a number of conditions. In other variations and embodiments, the sensor assemblies can be more fully integrated into the plungers, such that they are not easily separable from their associated plunger. In other variations and embodiments, a battery charger can be built directly into the plunger and sensor assembly such that no charging interface with the well head is required to charge the batteries. For example, a small generator could be attached to a roller that impacts the side wall of the tubing string periodically and during the plunger's ascent and descent could be utilized to generate a charging current. In another variation, flow through a small hole extending from the high pressure bottom side of the plunger to the low pressure side during the ascent could be utilized to power a generator. Of course, many other generator implementations are possible as would be obvious to one of ordinary skill in the art with the benefit of this disclosure. In other variations and embodiments of the plunger, the data acquisition and transfer assembly described above in relation to FIG. 7 could be integrated with the sensor assembly of FIG. 6 such that data could be obtained simultaneously at both the plunger and the well bottom. Various other permutations and combinations of the various elements and components described herein are contemplated.

Although as described herein the transfer of data is accomplished primarily when the plunger is in the catch/lubricator, alternative embodiment plungers are contemplated wherein the transfer of data occurs before the plunger reaches the surface or even continuously as the plunger travels the length of the tubing string, for instance, using wireless transmitters and receivers with highly directionalized antennas operating at suitable frequencies that facilitate transmission along the tubing string or casing.

Although the plunger lift control system described for use with one or more of the plunger embodiments and variations described herein includes a controller in which the data from the plunger are stored, in other variations and embodiments, the data retrieval and storage can be completely separate from the controller such that the data transfer device is not coupled to the controller directly but to another computer and/or storage device. In this configuration, the controller might not be adapted to analyze the data and make changes to the wells operating parameters; rather, the data are available for analysis by the separate computer or by the well operators for reservoir management purposes and for use in engineering analysis relating, but not limited, to reservoir characterization, reserve calculations, reservoir permeability, and interference testing. In other variations, where the data is stored in the controller, it may or may not be used by the controller to make changes to the operating parameters. In other variations of the control system, one or more of the peripherals described with reference to FIG. 9 may not be used, such as one of the casing and tubing string pressure sensors, or the flow sensor. In other variations, additional peripheral can be specified, such as additional sensors located at various locations on or in the Christmas tree.

Concerning the methodology of operating the plunger lift, numerous variations are contemplated depending on the particular data desired about the operation of a particular well and the particular controller and configuration of the well. For instance, the controller, as stated above, may not be configured to make changes to the well's operating parameters based on the data collected from the plunger and/or well bottom. In other systems, the flow valve may be configured to open at a certain time during a cycle rather than in response to the pressure in the tubing string and/or casing. The particular time could be based on analysis of the data obtained from a plunger sensor assembly over a period of time and found to offer better efficiencies than basing the opening of the flow valve on the peripheral controller pressure sensors.

I claim:

1. A plunger adapted for use with a well, the plunger comprising:

a substantially cylindrical body;

at least one memory storage device;

at least one data controller, the at least one data controller being (i) coupled with the at least one memory storage device and (ii) adapted to manage the flow of data in and out of the at least one memory storage device; and at least one data transfer device coupled with the at least one data controller, the at least one data transfer device adapted to facilitate the flow of data between the plunger and an external device.

2. The plunger of claim 1, wherein the at least one data transfer device comprises a first set of electrical contacts located on the exterior of the body.

3. The plunger of claim 2, wherein the power supply is electrically coupled to a second set of electrical contacts located on the exterior of the body.

4. The plunger of claim 1, wherein the at least one data transfer device comprises a wireless transmitter.

5. The plunger of claim 1, further comprising one or more sensors at least partially contained within the body, the one or more sensors being: (a) coupled with the at least one data controller and the at least one memory storage device; and (b) configured to monitor one or more of the group of (1) temperature, (2) pressure, (3) plunger load, (4) fluid type, (5) plunger acceleration, (6) plunger velocity, and (7) plunger position.

6. The plunger of claim 1, further comprising a power supply electrically coupled to the at least one data controller and the at least one memory storage device.

7. A control system of a plunger lift equipped well wherein the well includes (i) a tubing string extending down a borehole, (ii) a plunger adapted to ascend and descend between a well head and a lower portion of the well bore in the tubing string wherein the plunger includes one or more sensor assemblies for monitoring and recording data concerning physical conditions in the well, the one or more sensor assemblies including an output interface and a power supply, (iii) the well head, (iv) a plunger lubricator/catch adapted to periodically hold the plunger above the well head and (v) a flow line in fluid communication with the tubing string via the well head, the control system comprising:

a controller;

a flow valve operatively coupled to the controller and fluidly coupled to the flow line, the flow valve being adapted to open or close responsive to signals from the controller;

one or more pressure sensors operatively coupled to the controller located at or proximate an associated well head;

a plunger release mechanism operatively coupled to the controller, the plunger release mechanism being adapted to release the plunger from the lubricator/catch;

a input interface operatively coupled to the controller adapted to couple with the output interface of the plunger and receive data therefrom.

8. The control system of claim 7, wherein the controller is adapted to selectively vary the operation of the flow valve and the plunger release mechanism based on the data received from the plunger.

9. The control system of claim 7, further comprising a charging device adapted to recharge the plunger power supply.

10. The control system of claim 7, wherein the input interface comprises a wireless receiver.

11. The control system of claim 10, wherein the input interface comprises one or more sets of electrical contacts adapted to interface with corresponding contacts of the plunger output interface.

* * * * *